US011864611B2

(12) United States Patent
Thomson

(10) Patent No.: US 11,864,611 B2
(45) Date of Patent: Jan. 9, 2024

(54) SHOWER CAP

(71) Applicant: SKIPPER HAIR INC., Edmonton (CA)

(72) Inventor: Gillian Rae Thomson, Edmonton (CA)

(73) Assignee: SKIPPER HAIR INC., Edmonton (CA)

( * ) Notice: Subject to any disclaimer, the term of this patent is extended or adjusted under 35 U.S.C. 154(b) by 0 days.

(21) Appl. No.: 17/471,978

(22) Filed: Sep. 10, 2021

(65) Prior Publication Data

US 2022/0125147 A1 Apr. 28, 2022

Related U.S. Application Data

(60) Provisional application No. 63/105,651, filed on Oct. 26, 2020.

(51) Int. Cl.
*A42B 1/22* (2006.01)

(52) U.S. Cl.
CPC ..... *A42B 1/22* (2013.01)

(58) Field of Classification Search
CPC .... A42B 1/22; A42B 1/25; A42B 1/04; A42B 1/041; A42B 1/049; A42B 1/12; A42B 1/012; A45D 8/40
See application file for complete search history.

(56) References Cited

U.S. PATENT DOCUMENTS 1,243,567 A * 10/1917 Spindler ..... A42B 1/22 2/195.2
1,521,149 A * 12/1924 Clarizio ..... A45D 8/40 132/274
RE16,972 E * 5/1928 Epstein ..... A42B 1/22 2/171.04
RE17,064 E * 8/1928 Fischer ..... A42B 1/22 2/173.5
1,920,387 A * 8/1933 Harper ..... A42B 1/12 D2/880
1,992,285 A * 2/1935 Blum ..... A42B 1/22 2/183
2,063,232 A * 12/1936 Davies ..... A42B 1/12 450/112
2,106,570 A * 1/1938 Lipton ..... A42B 1/22 2/171.7
2,497,892 A * 2/1950 Klar ..... A42B 1/12 D2/880
3,206,761 A * 9/1965 Melnikoff ..... A42B 1/12 2/171.01
3,321,774 A * 5/1967 Tames ..... A42B 1/012 2/181
3,370,304 A * 2/1968 Pelletier ..... A42B 1/12 D2/883

(Continued)

*Primary Examiner* — Heather Mangine
*Assistant Examiner* — Raquel M. Weis
(74) *Attorney, Agent, or Firm* — Perry + Currier Inc.

(57) ABSTRACT

A present disclosure provides a headpiece that includes a water-resistant covering for covering the user's hair and a band for encircling the user's head. The headpiece further includes an opening between the band and the water-resistant covering for accommodating hair. The opening can be enclosed with a tightening mechanism. This allows the user to adjust the band around the hairline independently from the step of securing hair under the water-resistant covering.

14 Claims, 12 Drawing Sheets

(56) References Cited

U.S. PATENT DOCUMENTS 3,714,670 A * 2/1973 Pollack ..... A42B 1/12 2/918
3,750,681 A * 8/1973 Claunch ..... A45D 8/40 2/172
4,400,830 A * 8/1983 Gaitan ..... A42B 1/12 2/68
4,468,815 A * 9/1984 Pellegri ..... A42B 1/12 2/237
4,815,148 A * 3/1989 Satterfield ..... A42B 1/22 D2/884
4,937,885 A * 7/1990 Gregg ..... A42B 1/041 2/209.12
5,025,505 A * 6/1991 Fekete, Sr. ..... A42B 1/22 2/918
5,321,854 A * 6/1994 Kronenberger ..... A42B 1/225 2/209.3
5,548,845 A * 8/1996 Gallup ..... A42B 1/22 2/195.2
5,822,800 A * 10/1998 Anderson ..... A42B 1/06 2/202
5,875,494 A * 3/1999 Garnier, Jr. ..... A42B 1/225 2/171.5
5,906,006 A * 5/1999 Castro, Jr. ..... A42B 1/041 2/207
5,915,535 A * 6/1999 Henrekin-Jordan .... A41F 9/002 2/183
5,933,872 A * 8/1999 Lema ..... A42B 1/225 2/209.3
6,131,249 A * 10/2000 Suenaga ..... A42B 1/22 24/442
6,330,721 B1 * 12/2001 Wallace ..... A42B 1/12 2/67
6,345,395 B1 * 2/2002 Chilton ..... A42B 1/12 2/202
6,363,537 B1 * 4/2002 Park ..... A42B 1/22 2/181.2
6,401,255 B1 * 6/2002 Douglas ..... A42B 1/225 2/207
6,467,096 B1 * 10/2002 Coluccio ..... A42B 1/22 2/195.2
6,941,581 B1 * 9/2005 England ..... A42B 1/22 2/195.2
6,966,071 B1 * 11/2005 Cascone ..... A42B 1/0182 2/195.2
D546,031 S * 7/2007 Pearson ..... D2/875
7,665,154 B2 * 2/2010 Gerstel Costello .... A42B 1/225 2/195.3
7,945,971 B2 * 5/2011 Garza ..... A42B 1/225 2/171.4
D720,120 S * 12/2014 Simmonds ..... D2/885
D757,401 S * 5/2016 Orevik ..... D2/878
9,398,780 B1 * 7/2016 Matallana ..... A42B 1/12
D775,792 S * 1/2017 De Jesu ..... D2/867
9,538,799 B2 * 1/2017 Dodd ..... A42B 1/12
9,555,288 B1 * 1/2017 Lucas ..... A63B 33/00
9,907,381 B2 * 3/2018 Tussey ..... A42B 1/049
D820,565 S * 6/2018 Pickett ..... D2/883
10,021,930 B2 * 7/2018 De Jesu ..... A42B 1/12
10,661,122 B1 * 5/2020 Banks ..... A63B 33/00
11,110,320 B2 * 9/2021 Bono ..... A42B 1/12
11,304,468 B2 * 4/2022 Ault ..... A42B 1/225
2002/0029404 A1 * 3/2002 Friedman ..... A42B 1/22 2/195.2
2002/0162160 A1 * 11/2002 Anderson ..... A42B 1/22 2/200.1
2004/0163162 A1 * 8/2004 Benziger ..... A63B 23/025 2/413
2005/0028249 A1 * 2/2005 Molnar ..... A42B 1/04 2/200.1
2005/0108810 A1 * 5/2005 Yan ..... A42B 1/225 2/195.4
2006/0137074 A1 * 6/2006 Laing ..... A42B 1/225 2/195.2
2006/0143799 A1 * 7/2006 Young ..... A42B 1/22 2/209.13
2008/0092272 A1 * 4/2008 Vainio ..... A42B 1/225 2/209.3
2008/0196144 A1 * 8/2008 Ruiz ..... A41D 13/1236 2/171
2008/0201825 A1 * 8/2008 Chun ..... A42B 1/225 2/209.13
2008/0209615 A1 * 9/2008 Raftery ..... A42B 1/225 2/209.13
2009/0255030 A1 * 10/2009 Guy ..... A42B 1/225 2/195.3
2010/0031421 A1 * 2/2010 Chang ..... A45D 8/40 2/174
2013/0298929 A1 * 11/2013 Cole ..... A42B 1/12 132/200
2014/0101821 A1 * 4/2014 Dammann ..... A42B 1/12 2/171.4
2015/0135392 A1 * 5/2015 Bono ..... A42B 1/12 2/68
2017/0027262 A1 * 2/2017 Palmer ..... A42B 1/22
2017/0042267 A1 * 2/2017 Guice ..... A42B 1/12
2017/0095027 A1 * 4/2017 Campbell ..... A42B 1/22
2017/0258166 A1 * 9/2017 Charles, Jr. ..... A42B 1/225
2017/0354194 A1 * 12/2017 Arritola ..... A42B 1/0185
2017/0354195 A1 * 12/2017 Gelberg ..... A42B 1/22
2017/0360138 A1 * 12/2017 Guice ..... A42B 1/206
2018/0255860 A1 * 9/2018 Heaton ..... A42B 7/00
2019/0045864 A1 * 2/2019 Teat ..... A42B 1/0187
2019/0053560 A1 * 2/2019 Yoo ..... A42B 1/225
2020/0214382 A1 * 7/2020 Dann ..... A42B 1/225
2020/0305531 A1 * 10/2020 Harry ..... A42B 1/225
2021/0259345 A1 * 8/2021 Michaels ..... A42B 1/22
2021/0315347 A1 * 10/2021 Fayomi-Olaleye ..... A45D 8/40
2021/0361014 A1 * 11/2021 Bono ..... A42B 1/225
2022/0125147 A1 * 4/2022 Thomson ..... A42B 1/12

* cited by examiner

SHOWER CAP

FIELD OF THE INVENTION

The present invention relates to headpieces, and more particularly to water-resistant headpieces for use in the shower.

BACKGROUND OF THE INVENTION

Washing one's hair every day can lead to excess dryness of the scalp and hair and can fade artificial hair colour. In addition, styling hair from wet to dry can take extra time and effort daily. Many people are now realizing these benefits of not washing their hair every day. It is often a challenge, however, to find a suitable covering for the hair to prevent it from getting wet and ruining a previous hair style during a shower or bath.

Conventional headpieces that intend to solve this problem, commonly known as shower caps, are comprised of a single piece of waterproof material—often a thin, single-use plastic—with an elastic perimeter. Some improvements of this conventional shower cap design include the use of more durable materials, but they remain similar in the basic spherical shape and depend on the use of elastic in the perimeter for a secure fit around the head.

SUMMARY

It is an aspect of the present disclosure to provide a headpiece.

The above aspects can be attained by a headpiece that includes, a water-resistant covering for covering the user's hair, a band for encircling a user's head, and an adjustment mechanism for adjusting a circumference of the band around the user's head. A first portion of the perimeter of the water-resistant covering extends along a first segment of the band, leaving an opening between the band and the covering. In particular, the opening is defined by the second segment of the band and the second portion of the perimeter. The opening can be enclosed with a tightening mechanism.

The perimeter of the covering may be larger than the circumference of the band and the tightening mechanism may be configured to reduce the perimeter of the covering. The tightening mechanism may include a drawstring enclosed by a casing which is secured along the second portion of the perimeter. The casing may be inset from the second portion of the perimeter. The drawstring may be elastic.

The band may be inelastic.

The band may be substantially flat.

The adjustment mechanism may include a fastener for securing a first end of the band to a second end of the band. The fastener may include a hook-and-loop fastener. The fastener may include a buckle.

It is a further aspect of the present disclosure to provide a method of manufacturing a headpiece.

The above aspects can be attained by providing a band for encircling a user's head and an adjustment mechanism for adjusting the band circumference. A first segment of the band is secured to a water-resistant covering for covering the user's hair. A first portion of the perimeter of the covering is secured along a first segment of the band such that an opening is left in the headpiece between a second segment of the band and a second portion of the perimeter. A tightening mechanism for enclosing the opening is secured to the second portion of the perimeter.

The perimeter of the covering may be larger than the band circumference and the tightening mechanism may be configured to reduce the perimeter of the covering. The tightening mechanism may include a drawstring enclosed by a casing which is secured along the second portion of the perimeter. The casing may be inset from the second portion of the perimeter. The drawstring may be elastic.

The band may be inelastic.

The band may be substantially flat.

The adjustment mechanism may include a fastener for securing a first end of the band to a second end of the band. The fastener may include a hook-and-loop fastener. The fastener may include a buckle.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
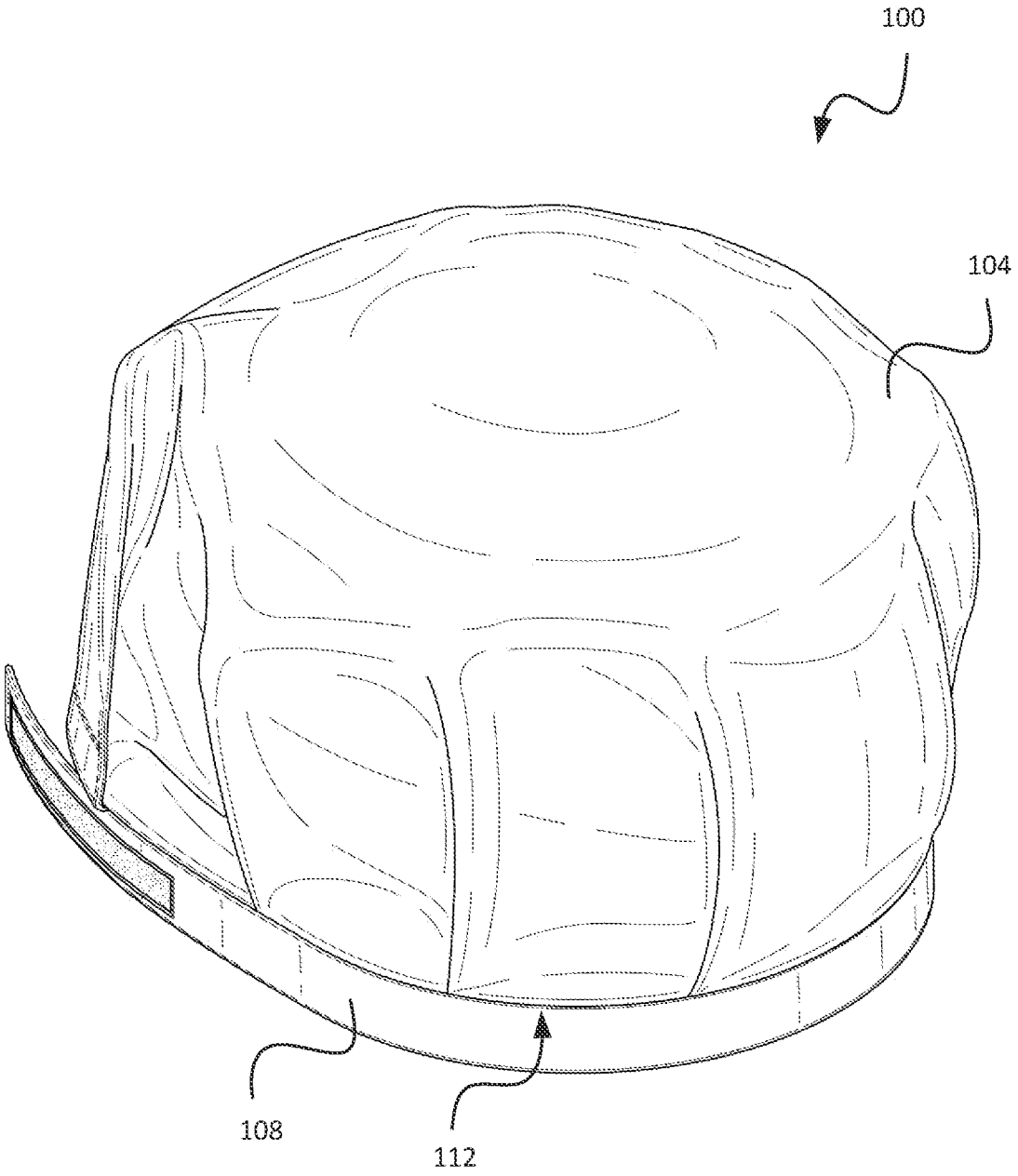
FIG. 1 is a front perspective view of the headpiece according to an embodiment of the invention.

Conventional shower caps do not allow much flexibility in the tightness or positioning of the elastic enclosure around the hairline, making it uncomfortable to wear and sometimes allowing water to reach the hair. If the user has long hair, it can be difficult to get all hair into the cavity, while at the same time positioning the elastic around the hairline. After it is in place around the hairline, the user may lift the elastic to tuck stray long hairs into the cap but doing so may release other hair from the cavity, and this process needs to be repeated many times before entering the bath or shower, creating frustration for the wearer.

The elastics used around the perimeter can be very tight, leaving an unsightly indentation in the skin around the hairline after the cap is removed. Furthermore, the elastic can stretch out over time, becoming too loose to effectively stay in place or prevent water from reaching the hair. The user then disposes of the shower cap and replaces it with a new one, only to start this cycle of starting too tight, stretching out the elastic again then disposing of it. This practice is wasteful and not environmentally responsible.

The present invention is a headpiece for covering the user's hair.

FIGS. 1 to 12 show a headpiece generally at 100. The headpiece 100 comprises a band 108 for encircling the user's head and a water-resistant covering 104 for covering the user's hair.

The water-resistant covering 104 may be generally shaped as a rounded cavity to cover the user's hair. In some embodiments, the water-resistant covering 104 comprises a single sheet of material which is shaped through a number of conventional techniques such as pleating, darting, gathering, or a combination thereof. In embodiments where the water-resistant covering 104 is darted, the darts may be sealed with a water-resistant sealant. In other embodiments, the water-resistant covering 104 comprises two or more sheets of material which are sewn together to achieve the desired shape and size. In embodiments where the water-resistant covering 104 is sewn together, the seams may be sealed with a water-resistant sealant. Some materials that may be suitable for the water-resistant covering 104 include polyester, polyurethane laminate, nylon, vinyl, and combinations thereof. It may be desirable to select a material that is washable such that the headpiece 100 can be cleaned. It may be further desirable to select a material that is durable so that the headpiece 100 can be reused. Reusing the headpiece 100 may reduce landfill waste caused by single-use shower caps and may further reduce energy consumption by manufacturers of shower caps.

The water-resistant covering 104 may comprise one or more layers. In some embodiments, the water-resistant covering 104 comprises an outer layer facing away from the user's head and an inner layer, facing towards the user's head. The outer layer may comprise a material that is selected for its water-resistance, while the inner layer may comprise a material that is selected for other properties. For example, the inner layer may comprise a material that is selected for user comfort, moisture-wicking, anti-bacterial properties, anti-fungal properties, sound dampening, breathability, or a combination thereof. Suitable materials for the inner layer include, but are not limited to, polyester, cotton, linen, satin, silk, rayon, lyocell, wool, spandex, chiffon, terry cloth, velvet, and a combination thereof. In other embodiments, both the outer layer and the inner layer comprise water-resistant materials.

The perimeter 112 of the water-resistant covering 104 at least partially extends along the band 108. The band 108 may be attached or integral to the perimeter 112. In embodiments where the band 108 is attached to the perimeter 112, a number of suitable attachment means are contemplated for attaching the water-resistant covering 104 to the band 108 including but not limited to adhesives, thread, and heat-bonding. In embodiments where the band 108 is integral to the perimeter 112, the perimeter 112 of the water-resistant covering 104 may comprise the band 108.

The headpiece 100 further includes an adjustment mechanism (shown at 302 in FIGS. 3, 4 and 7) for adjusting a circumference (shown at 1012 in FIG. 10) of the band. Adjusting the band circumference 1012 may facilitate a more secure fit around the user's head. In some use cases, the adjustment mechanism 302 (shown at 302 in FIGS. 3, 4 and 7) may be configured to adjust the band circumference 1012 to approximately the same size as the circumference of the user's head, and in particular the circumference of the user's head around the user's hairline. In one example, the headpiece 100 encircles the user's head and then the band circumference 1012 is expanded or contracted to fit the user's head. In this embodiment, the band 108 has a first end 204 and a second end 208, however in other embodiments, the band 108 may comprise a continuous loop. The adjustment mechanism 302 (shown at 302 in FIGS. 3, 4 and 7) may include a fastener for securing the first end 204 to the second 208. In the embodiment shown, the fastener is a hook-and-loop fastener, however a number of possible fasteners are contemplated including a buckle, a button, a snap, drawstring, a safety pin, a D-ring, magnet, hook and eye fastener, a cord, and a combination thereof.

Figure 2:
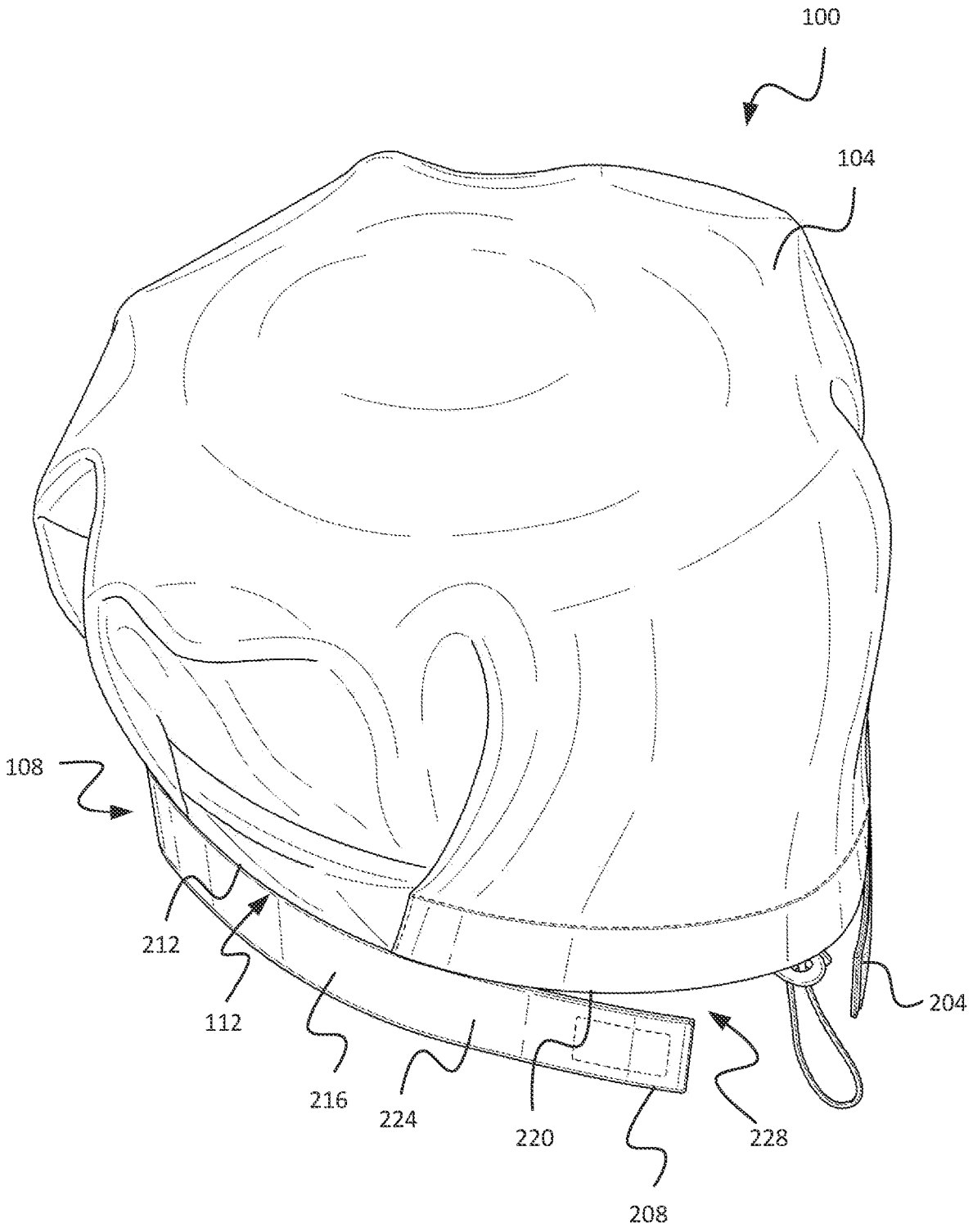
FIG. 2 is a rear perspective view of the headpiece from FIG. 1.

In FIG. 2, a rear perspective view of the headpiece 100 is shown. The band 108 is configured to encircle a user's head. The band 108 may be round, flat, wide, or narrow, however the band is not particularly limited. Embodiments of the headpiece 100 where the band 108 is flat and wide may allow the user to tighten the band without causing the discomfort that would otherwise arise from tightening a round, narrow band around the user's head. Furthermore, configurations where the band 108 is flat may exhibit increased contact between the band 108 and the user's head, which may improve the efficacy of blocking moisture from reaching the user's hair. A range of widths may be suitable for the band 108. In some embodiments, the width of the band 108 may be approximately 2.25 centimeters wide. In yet other embodiments, the width of the band 108 may be approximately 2.5 centimeters wide. In further embodiments, the width of the band 108 may be approximately 2.75 centimeters wide. The width of the band 108 is not particularly limited and other dimensions are contemplated.

The band 108 may be either elastic, inelastic, or partially elastic. In embodiments where the band 108 is partially elastic, the band 108 may include inelastic segments and elastic segments such that the band 108 is substantially in contact with the user's head when worn.

The adjustment mechanism 302 overcomes several disadvantages of prior art shower caps which include a non-adjustable elastic band. In the prior art shower caps, the elastic band may be either too tight or not tight enough; an overly tight elastic band may dig into the user's skin causing discomfort, whereas an insufficiently tight elastic may fail to maintain the user's hair underneath the headpiece. The adjustment mechanism 302 allows the user to adjust the tension in the band 108 to suit the user's preferences. Furthermore, traditional shower caps would often stretch out with repeated use until they were no longer effective at blocking moisture from reaching the user's hair. In the presently described headpiece 100, the adjustment mechanism 302 may be tightened to compensate for stretching of the band 108 so that the headpiece 100 may be reused.

Some materials that may be suitable for the band 108 include polyester, polyurethane laminate, nylon, vinyl, and combinations thereof. The band 108 may comprise one or more layers. In some embodiments, including the one shown in FIG. 3, the band 108 comprises an outer layer 304 facing away from the user's head and an inner layer 308, facing towards the user's head. The outer layer 304 may comprise a material that is selected for its water-resistance, while the inner layer 308 may comprise a material that is selected for other properties. For example, the inner layer 308 may comprise a material that is selected for user comfort, moisture-wicking, anti-bacterial properties, anti-fungal properties, sound dampening, breathability, or a combination thereof. Suitable materials for the inner layer include, but are not limited to, polyester, cotton, linen, satin, silk, rayon, lyocell, wool, spandex, chiffon, velvet, terry cloth, and a combination thereof. The inner layer 308 may further be selected to improve contact with the surface of the user's head or to prevent the headpiece 100 from slipping. In other embodiments, both the outer layer 304 and the inner layer 308 comprise water-resistant materials.

As shown in FIG. 2, the water-resistant covering 104 is not attached to the band 108 all the way around its perimeter 112. The perimeter 112 of the water-resistant covering 104 includes a first portion of the perimeter 212 which is attached to a first segment of the band 216, and a second portion of the perimeter 220 which is unattached to the second segment of the band 224. Since the band 108 shown here is discontinuous, the second segment of the band 224 generally comprises the first end 204 and the second end 208. Due to the partial attachment of the water-resistant covering 104 to the band 108, an opening 228 is formed between the second segment 224 and the second portion of the perimeter 220. In the configuration shown in FIG. 2, the opening 228 is not enclosed because the first and second ends 204, 208 are not attached. However, when the first and second ends 204, 208 are attached, or in embodiments where the band 108 comprises a continuous loop, the opening 228 is enclosed by the second segment 224 and the second portion of the perimeter 220.

In general, the size of the opening 228 may depend both on the configuration of the adjustment mechanism 302 and the extent to which the first portion of the perimeter 212 extends along the first segment of the band 216. If the adjustment mechanism (shown in FIG. 3 at 302) reduces the band circumference 1012, the size of the opening 228 may be likewise reduced as a result. If the adjustment mechanism (shown in FIG. 3 at 302) expands the band circumference 1012, the size of the opening 228 may be likewise expanded as a result. The length of the second portion of the perimeter 220 and the length of the second segment of the band 224 may further affect the size of the opening 228. To increase the size of the opening 228, the length of the second portion of the perimeter 220 and the second segment of the band 224 may be lengthened. To reduce the size of the opening 228, the length of the second portion of the perimeter 220 and the second segment of the band 224 may be shortened. In some configurations, the second segment of the band 224 may form about a third of the length of the band 108. In other configurations, the second segment of the band 224 may form about a fourth of the length of the band 108. In further configurations, the second segment of the band 224 may form about a fifth of the length of the band 108. The opening 228 may be sized and shaped to accommodate the user's hair. For instance, for thicker hair, it may be desirable for the headpiece 100 to include a relatively large opening 228, whereas for thinner hair, a smaller opening 228 may be desirable.

Figure 3:
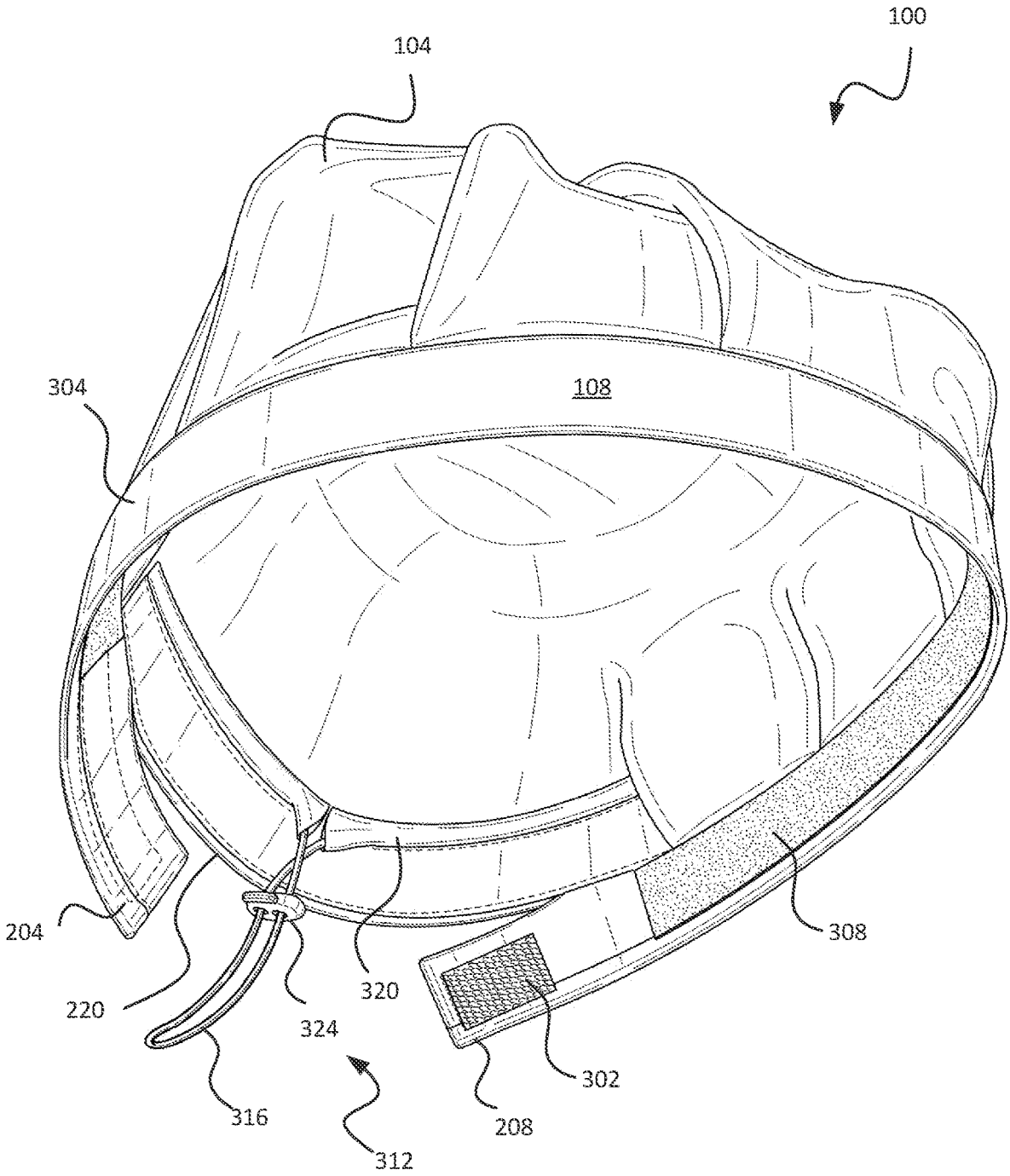
FIG. 3 is a bottom perspective view of the headpiece from FIG. 1.
Figure 4:
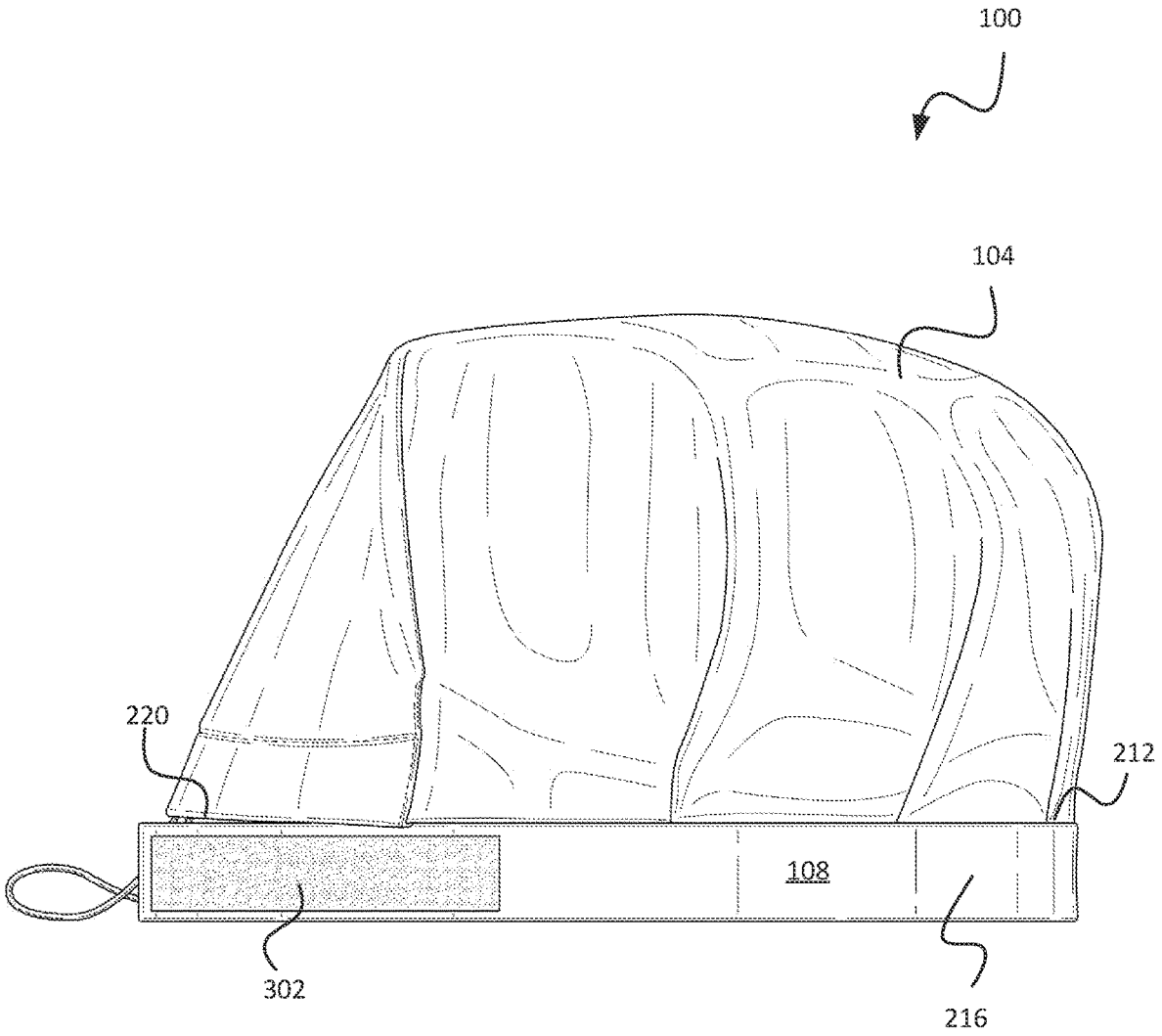
FIG. 4 is a side view of the headpiece from FIG. 1.
Figure 5:
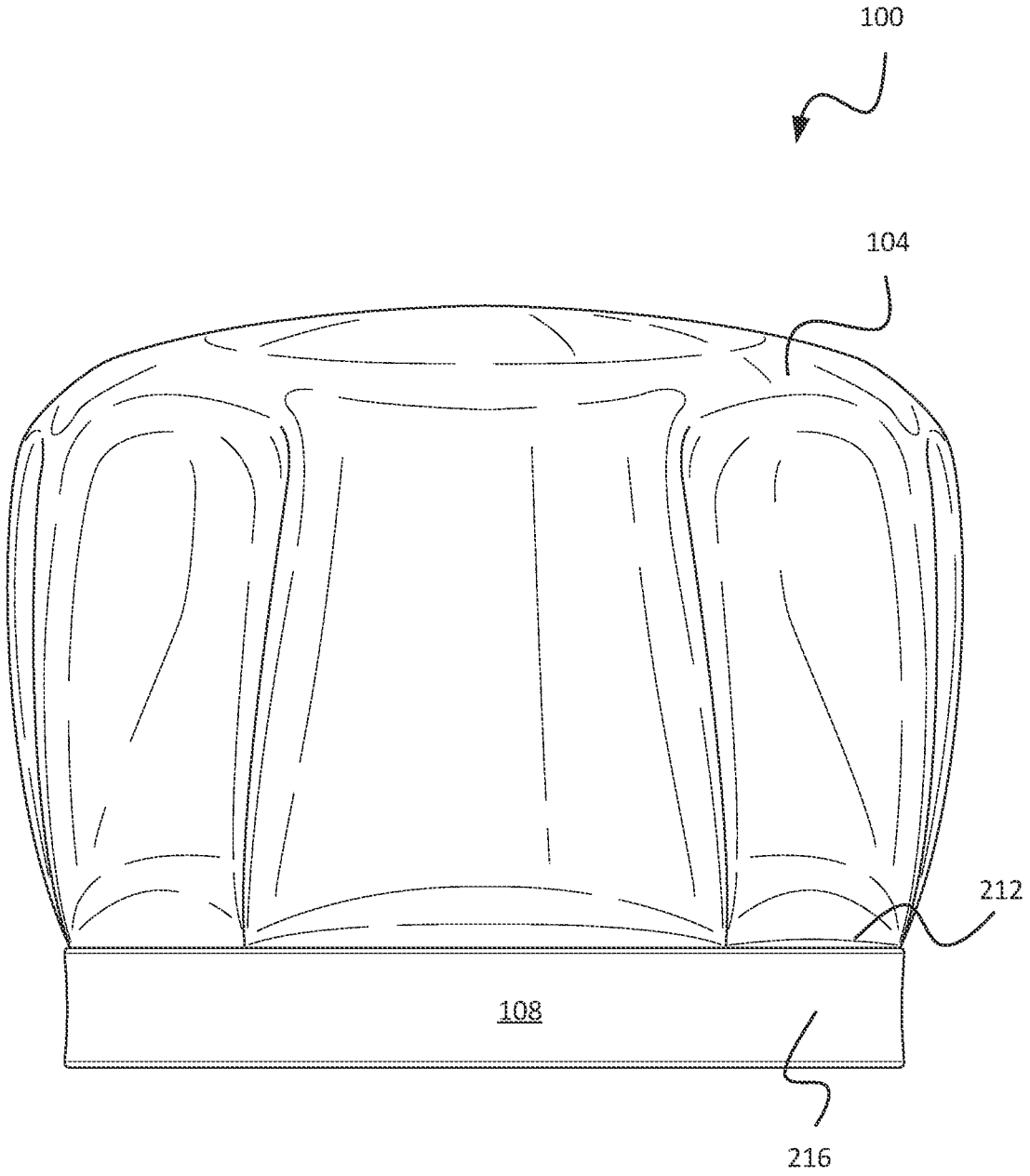
FIG. 5 is a front view of the headpiece from FIG. 1.
Figure 6:
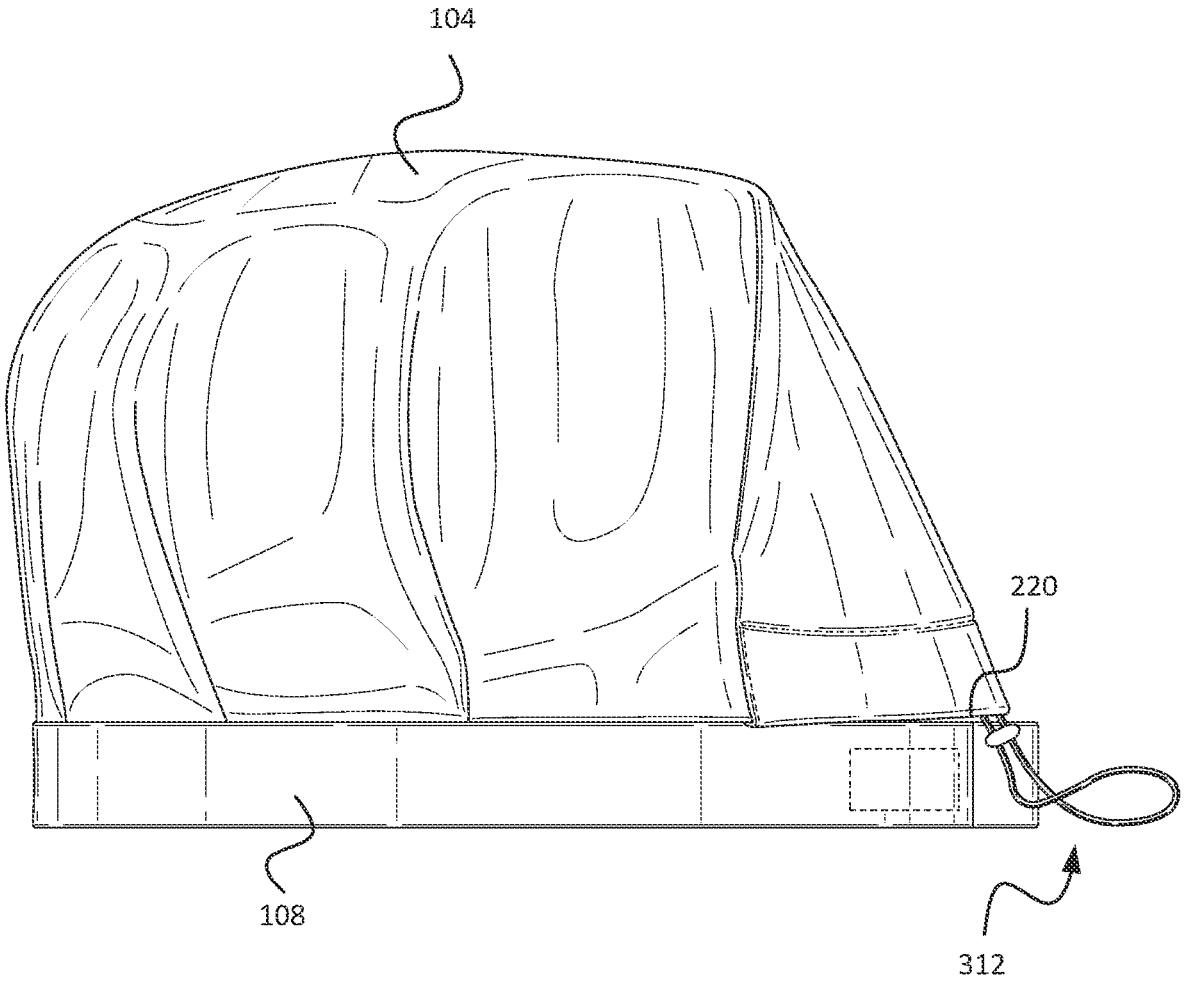
FIG. 6 is a side view of the headpiece from FIG. 1.
Figure 7:
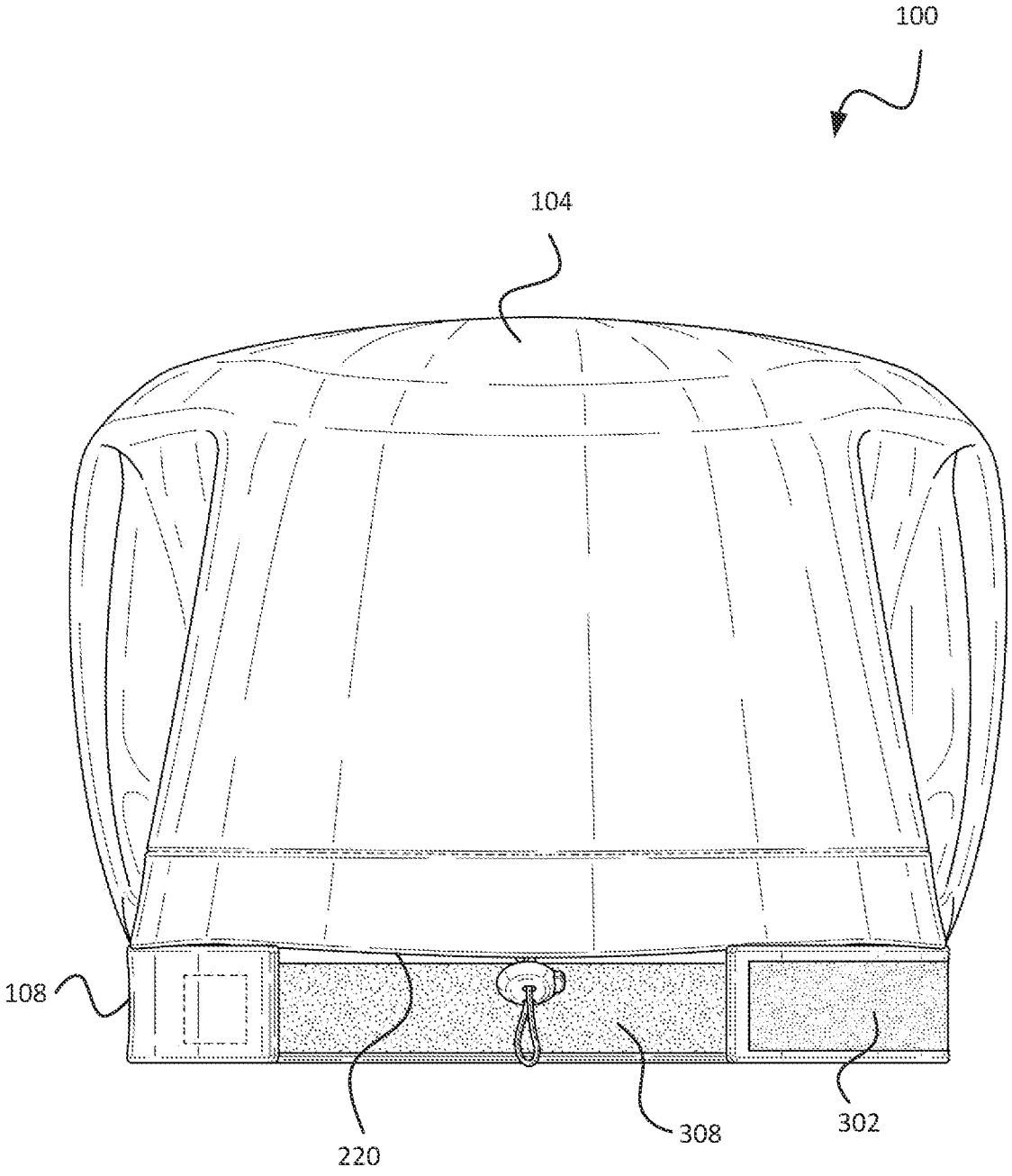
FIG. 7 is a rear view of the headpiece from FIG. 1.
Figure 8:
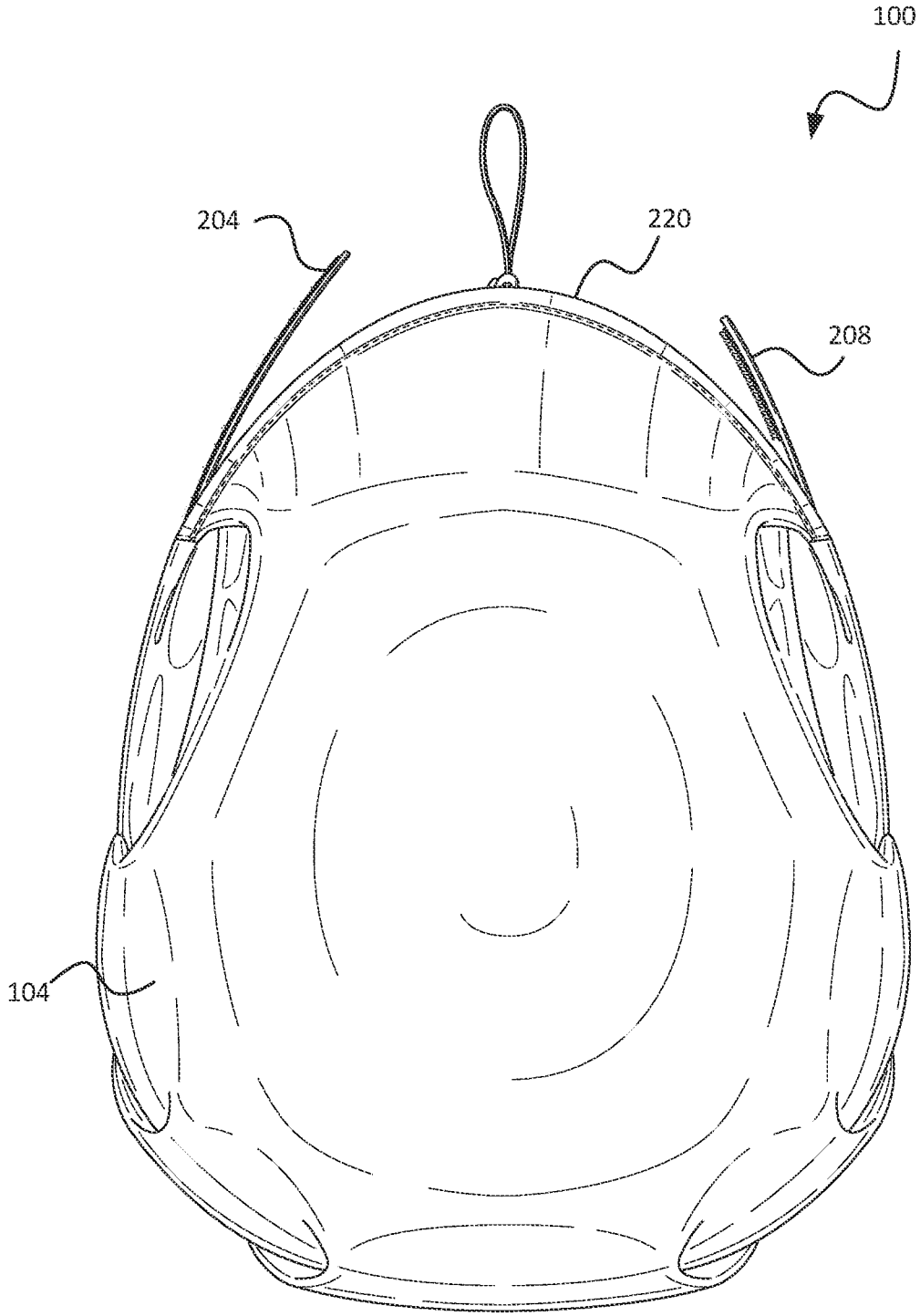
FIG. 8 is a top view of the headpiece from FIG. 1.
Figure 9:
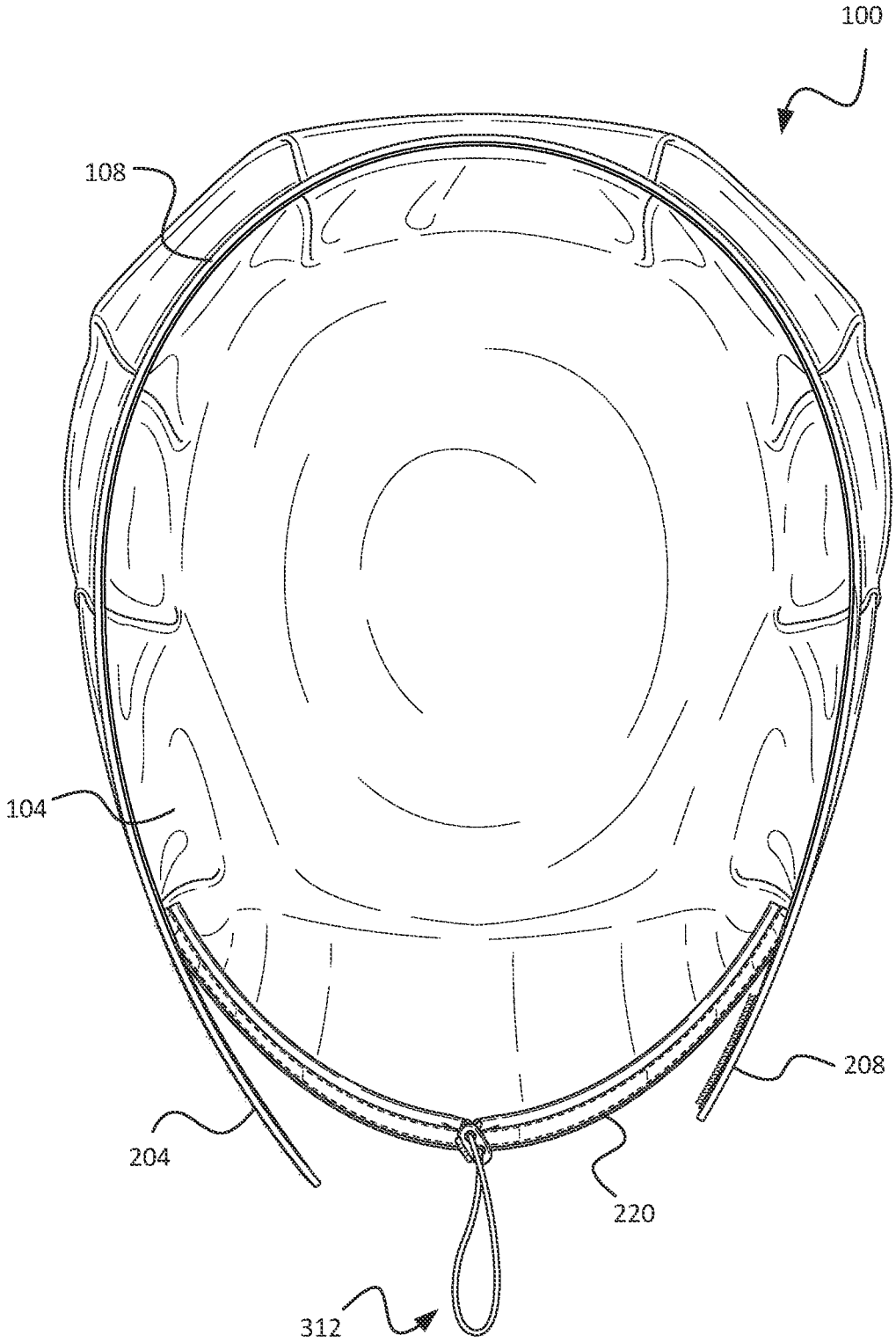
FIG. 9 is a bottom view of the headpiece from FIG. 1.

Turning to FIG. 3, the headpiece 100 further includes a tightening mechanism 312 for enclosing the opening 228. A number of possible tightening mechanisms 312 are contemplated including, but not limited to, a drawstring, an elastic, hook-and-loop fastener, buckle, a snap, a button, a strap, a string, a zipper, a toggle, a material having complimentary parts which mate to each other when brought or pressed together such as a hook and eye, a hook, a clip, a stud, a mesh, a magnet, a stay, a twist tie, an adjustable pull though circle loop latch, or a combination thereof. The perimeter 112 of the water-resistant covering 104 may be larger than the band circumference 1012 and the tightening mechanism 312 may be configured to shorten the perimeter 112. The tightening mechanism 312 may be incorporated into the headpiece 100 in a number of suitable positions. For instance, the tightening mechanism 312 may be inset from the second portion of the perimeter 220, as shown in FIG. 3. The portion of the water-resistant covering 104 between the tightening mechanism 312 and the second portion of the perimeter 220 may provide a protective hood for preventing water from entering the opening 228.

In the embodiment shown, the tightening mechanism 312 comprises a drawstring 316 enclosed by a casing 320, with the length of the drawstring 316 being adjustable with a toggle 324. When the drawstring is tightened, the size of the opening 228 may be reduced.

Figure 10:
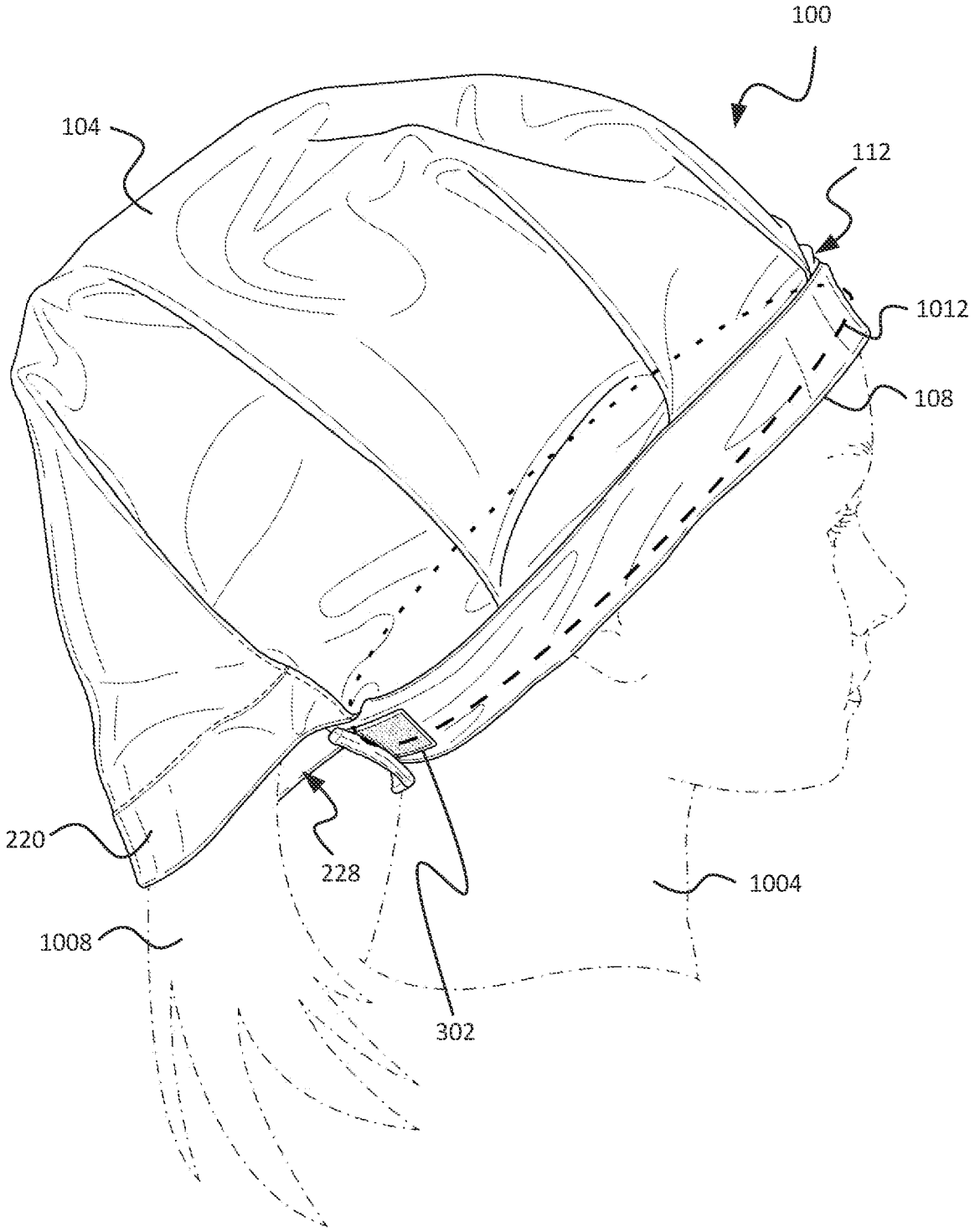
FIG. 10 is a perspective view of a user showing the installation process of the headpiece from FIG. 1.
Figure 11:
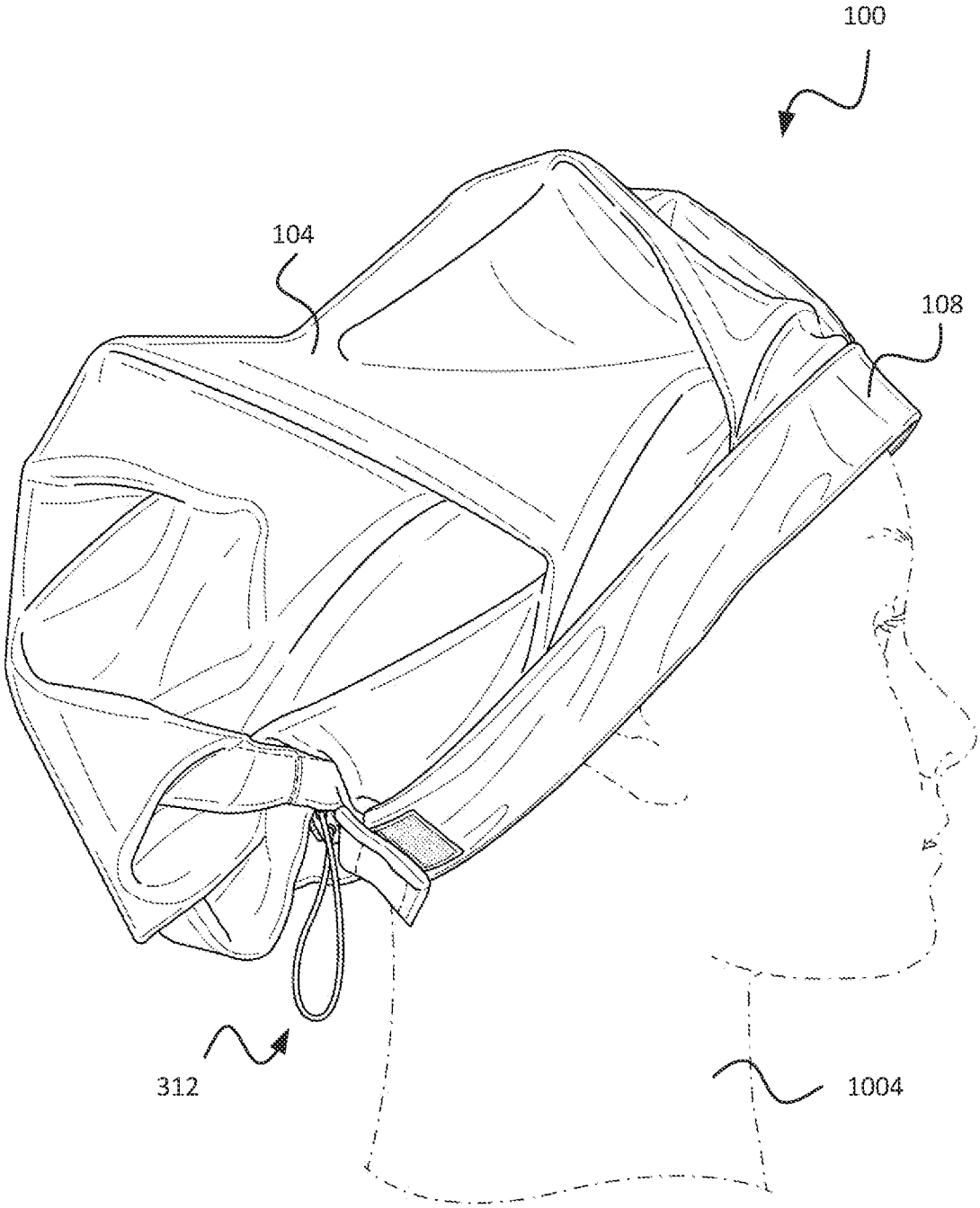
FIG. 11 is a perspective view of a user showing the installation process of the headpiece from FIG. 1.
Figure 12:
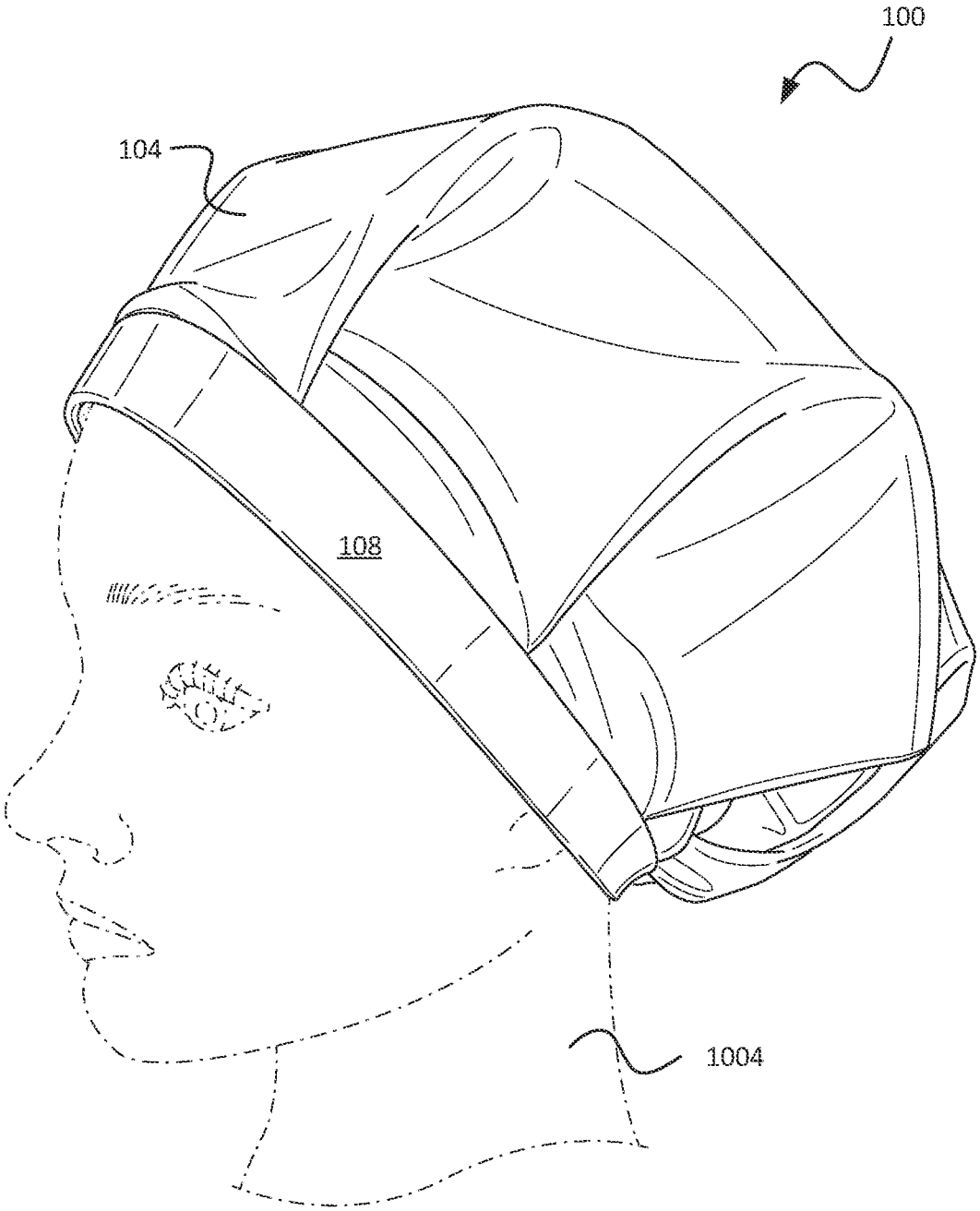
FIG. 12 is a perspective view of a user showing the installation process of the headpiece from FIG. 1.

Installation on the wearer's head may be described as a two-step process, as illustrated in FIGS. 10 to 12.

First, the headpiece 100 is placed around the user's head, as shown in FIG. 10. The headpiece 100 may be positioned such that the band 108 crosses the user's forehead and passes around the base of the skull so as to cover the user's hair. The band 108 may be worn below the ears, over the ears, tucked behind the ears, or above the ears according to the user's preference. Using the adjustment mechanism 302, the band circumference 1012 may be adjusted to secure the headpiece 100 around the user's head with the desired amount of tension. The user 1004 may wish to further adjust the positioning of the band 108 to ensure that the hairline is completely covered by the headpiece 100.

If the user 1004 has long hair, the hair 1008 may be passed through the opening 228. In the implementation shown in FIG. 10, the first and second ends, 204, 208 have been affixed using the adjustment mechanism 302, enclosing the opening 228 by the second portion of the perimeter 220 and the second segment of the band 224. As previously explained, the band circumference 1012 is shorter than the perimeter 112. In the implementation shown, the difference between the circumference 1012 and the perimeter 112 causes a portion of the water-resistant covering 104 surrounding the opening 228 to protrude from the user's head. In contrast, if the band circumference 1012 was similar in size to the perimeter 112, the opening 228 might be positioned substantially flat against the user's head when worn by the user. Configurations where the opening 228 protrudes from the user's head may facilitate the user to pull hair 1008 through the opening 228. The opening 228 may be sized and positioned to accommodate the user's hair 1008. The opening 228 may be further configured to accommodate a hand passing through the opening 228 to reach the user's hair 1008. This may permit the user 1004 to place hairs into the headpiece 100 from within instead of trying to push hairs under the band 108 from outside the headpiece 100.

In the configuration shown, the opening 228 is directed downwards, which may help to keep moisture off the hair when the opening 228 is closed, however, the opening 228 is not particularly limited. Additionally, the headpiece 100 may be positioned in a number of configurations, according to the user's preference. In the implementation shown, the opening 228 is positioned at the back of the user's head, however, in other configurations, the opening 228 may be positioned at the front or side of the user's head.

Lastly, any hair 1008 protruding from the opening 228 is gathered up under the water-resistant covering 104 and the tightening mechanism 312 reduces the perimeter 112. FIGS. 11 and 12 shows the headpiece 100 after the performance of this step. By reducing the perimeter 112, the opening 228 may be constricted such that the opening 228 lays substantially flat against the user's head. If the tightening mechanism 312 includes a drawstring, as shown in this embodiment, the drawstring may then be tucked through the opening 228 to protect it from water and for the comfort of the user 1004.

In this way, the headpiece 100 allows the wearer to separate the tasks of encircling the hairline and gathering the long hair 1008 into the cavity into two separate steps. In comparison, traditional shower caps include just one opening so that gathering the hair and encircling the hairline must be performed concurrently. The headpiece 100 makes the installation easier to perform, more efficient, more effective, and more enjoyable for the wearer.

The band 108 and the tightening mechanism 312 cooperate to create a closed headpiece 100 that prevents moisture from reaching the user's hair inside. Thus, the headpiece 100 may prevent moisture from reaching the user's hair. The headpiece 100 may be comfortable to wear because it can be adjusted to the wearer's desired tension. If suitable materials are chosen, the headpiece 100 may be used many times without stretching out and losing effectiveness, this may allow the user to re-use the headpiece 100 multiple times and reduce the frequency with which a user must replace their headpiece 100.

Furthermore, the headpiece 100 may reduce waste and water consumption. In embodiments where the headpiece 100 comprises machine-washable materials, the user may launder the headpiece 100, lengthening the usable life of the headpiece 100 and reducing the need to produce many replacements. As a further environmentally-friendly benefit, the use of this headpiece may reduce the amount of water used during bathing or showering that would have been used towards washing the wearer's hair.

The above-described embodiments of the invention are intended to be examples of the present invention and alterations and modifications may be effected thereto, by those of skill in the art, without departing from the scope of the invention.

What is claimed is:

1. A shower cap comprising:

a band configured to encircle a user's head, the band including a first segment and a second segment;

an adjustment mechanism for adjusting a circumference of the band;

a water-resistant covering configured to cover the user's hair, the water-resistant covering including a perimeter, the perimeter including a first portion and a second portion, wherein the first portion of the perimeter extends along the first segment of the band and wherein the perimeter is larger than the band circumference;

an opening in a rear half of the shower cap, the opening defined by the second segment of the band and the second portion of the perimeter, wherein a portion of the water-resistant covering surrounding the opening is configured to protrude from the user's head such that the opening is directed downwards; and a tightening mechanism for closing the opening and shortening the perimeter, the tightening mechanism located entirely within the rear half of the shower cap, the tightening mechanism spaced from and parallel to the second portion of the perimeter;

wherein the tightening mechanism includes a drawstring enclosed by a casing, the casing secured along a portion of the cover spaced from the second portion of the perimeter.

2. The shower cap of claim 1, wherein the drawstring is elastic.

3. The shower cap of claim 1, wherein the band is inelastic.

4. The shower cap of claim 1, wherein the band is flat.

5. The shower cap of claim 1, wherein the band includes a first end and a second end, and wherein the adjustment mechanism includes a fastener for securing the first end to the second end.

6. The shower cap of claim 5, wherein the fastener includes a hook-and-loop fastener.

7. The shower cap of claim 5, wherein the fastener includes a buckle.

8. A method of manufacturing a shower cap, the method comprising:

providing a band configured to encircle a user's head, the band including a first segment, a second segment, and an adjustment mechanism for adjusting a circumference of the band;

securing a first segment of the band to a water-resistant covering configured to cover the user's hair, the water-resistant covering including a perimeter larger than the band circumference, the perimeter including a first portion and a second portion, wherein the first portion of the perimeter extends along the first segment of the band and wherein the second segment of the band and the second portion of the perimeter define an opening in a rear half of the shower cap, wherein a portion of the water- resistant covering surrounding the opening is configured to protrude from the user's head such that the opening is directed downwards; and securing a tightening mechanism to the rear half of the shower cap such that the tightening mechanism is entirely located within the rear half of the shower cap, and the tightening mechanism is spaced from and parallel to the second portion of the perimeter;

wherein the tightening mechanism is configured to close the opening and shorten the perimeter;

wherein securing the tightening mechanism to the rear half of the shower cap includes: securing a casing along a portion of the cover spaced from the second portion of the perimeter; and inserting a drawstring into the casing.

9. The method of claim 8, wherein the drawstring is elastic.

10. The method of claim 8, wherein the band is inelastic.

11. The method of claim 8, wherein the band is flat.

12. The method of claim 8, wherein the band includes a first end and a second end, and wherein the adjustment mechanism includes a fastener for securing the first end to the second end.

13. The method of claim 12, wherein the fastener includes a hook-and-loop fastener.

14. The method of claim 12, wherein the fastener includes a buckle.

* * * * *